US006776858B2

(12) United States Patent
Bansal et al.

(10) Patent No.: US 6,776,858 B2
(45) Date of Patent: Aug. 17, 2004

(54) PROCESS AND APPARATUS FOR MAKING MULTICOMPONENT MELTBLOWN WEB FIBERS AND WEBS

(75) Inventors: Vishal Bansal, Richmond, VA (US); Michael C. Davis, Midlothian, VA (US); Edgar N. Rudisill, Nashville, TN (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 332 days.

(21) Appl. No.: 09/915,688

(22) Filed: Jul. 26, 2001

(65) Prior Publication Data

US 2002/0034909 A1 Mar. 21, 2002

Related U.S. Application Data

(60) Provisional application No. 60/223,040, filed on Aug. 4, 2000.

(51) Int. Cl.[7] ..... D01D 5/26; D01D 5/32; D04H 1/56; D04H 1/72

(52) U.S. Cl. ..... 156/62.4; 156/167; 156/244.11; 156/244.18; 264/172.14; 264/172.17; 264/172.18; 264/211.14; 264/518

(58) Field of Search ..... 264/518, 172.14, 264/172.17, 172.18, 211.14, 517, 555; 156/62.4, 167, 244.11, 244.18

(56) References Cited

U.S. PATENT DOCUMENTS

| | | | | |
|---|---|---|---|---|
| 4,889,476 | A | 12/1989 | Buehning | |
| 5,225,014 | A * | 7/1993 | Ogata et al. | 156/167 X |
| 2002/0117254 | A1 | 8/2002 | Groten et al. | |
| 2002/0125601 | A1 * | 9/2002 | Allen | 264/555 X |

FOREIGN PATENT DOCUMENTS

| | | | |
|---|---|---|---|
| EP | 0 138 556 | A2 | 4/1985 |
| EP | 0 561 612 | A2 | 9/1993 |
| EP | 1 048 760 | A1 | 11/2000 |
| GB | 2121423 | A | 12/1983 |
| JP | 02 289 107 | A | 11/1990 |
| JP | 09049115 | A | 2/1997 |
| JP | 09067713 | A | 3/1997 |
| WO | WO 99/48668 | A1 | 9/1999 |
| WO | WO 0037723 | A2 | 6/2000 |

* cited by examiner

*Primary Examiner*—Leo B. Tentoni

(57) ABSTRACT

A process for forming multiple component meltblown fibers by extruding a first distinct melt-processable polymer through a row of first extrusion orifices, simultaneously extruding a second distinct melt-processable polymer through a row of second extrusion orifices, fusing the first and second melt-processable polymers into extruded composite filaments after extrusion, and pneumatically attenuating and breaking the extruded composite filaments with jets of high velocity gas so as to form the multiple component meltblown fibers.

7 Claims, 3 Drawing Sheets

PROCESS AND APPARATUS FOR MAKING MULTICOMPONENT MELTBLOWN WEB FIBERS AND WEBS

BACKGROUND OF THE INVENTION

1. Field of the Invention

This invention relates to multiple component meltblown fibers, multiple component meltblown fiber webs, and composite nonwoven fabrics that include multiple component meltblown fibers. The meltblown webs of the invention can be incorporated in composite fabrics suited for use in apparel, wipes, hygiene products, and medical wraps.

2. Description of Related Art

In a meltblowing process, a nonwoven web is formed by extruding molten polymer through a die and then attenuating the resulting fibers with a hot, high-velocity gas stream. In the production of a web comprised of meltblown fibers, it is sometimes desirable to form the fibers from more than one polymeric material where each material can have different physical properties and contribute different characteristics to the meltblown web. A conventional way to form such fibers is through a spinning process where the polymeric materials are combined in a molten state within the die cavity and are extruded together as a layered multicomponent polymer melt through a single spin orifice, as described in U.S. Pat. No. 6,057,256, which discloses the meltblowing of side-by-side bicomponent fibers onto a collector to form a coherent entangled web.

However, this method has significant limitations due to the compatibility constraints placed on the selection of the polymeric materials such that they will spin well together.

Meltblown fibers have been incorporated into a variety of nonwoven fabrics including composite laminates such as spunbond-meltblown-spunbond ("SMS") composite sheets. In SMS composites, the exterior layers are spunbond fiber layers that contribute strength to the overall composite, while the core layer is a meltblown fiber layer that provides barrier properties.

There is a need to provide a new method for forming meltblown fibers, and corresponding meltblown webs, that is more suitable for producing multiple component meltblown fibers, and in which the processing conditions for each polymeric component can be optimized individually.

SUMMARY OF THE INVENTION

The present invention is directed to a process for forming a multiple component meltblown fiber comprising extruding a first melt-processable polymer through a first extrusion orifice, simultaneously extruding a second melt-processable polymer through a second extrusion orifice, fusing said first and second melt-processable polymers into an extruded composite filament after extrusion, and pneumatically attenuating said extruded composite filament with at least one jet of high velocity gas so as to form said multiple component meltblown fiber. The composite filament may be broken by the jet of high velocity gas to form a plurality of fine discontinuous multiple component meltblown fibers.

A second embodiment of the present invention is directed to an extrusion die for meltblowing molten polymers comprising at least two separate polymer supply ports entering from an entrance portion of the die, said polymer supply ports communicating with separate extrusion capillaries having exit openings at an exit portion of the die, said extrusion capillaries cooperating as a combined orifice, at least one gas supply port entering from the entrance portion of the die, said gas supply port communicating with at least one gas jet extending through the die and said at least one gas jet arranged concentrically around the exit openings of said combined orifice, wherein said extrusion capillary exit openings and said gas jets communicate with a blowing orifice in the exit portion of the die.

In a third embodiment, the present invention is directed to an extrusion die for meltblowing molten polymers comprising a row of die orifices each comprising at least two separate polymer supply ports entering from an entrance portion of the die, each of said polymer supply ports communicating with separate extrusion capillaries having exit openings at an exit portion of the die, gas supply ports entering from the entrance portion of the die and arranged laterally to said polymer supply ports, said gas supply ports communicating with gas jets extending through the die and arranged laterally to the exit openings of said extrusion capillaries, wherein said extrusion capillary exit openings and said gas jets communicate with a blowing orifice in the exit portion of the die.

DETAILED DESCRIPTION OF THE INVENTION

Figure 1:
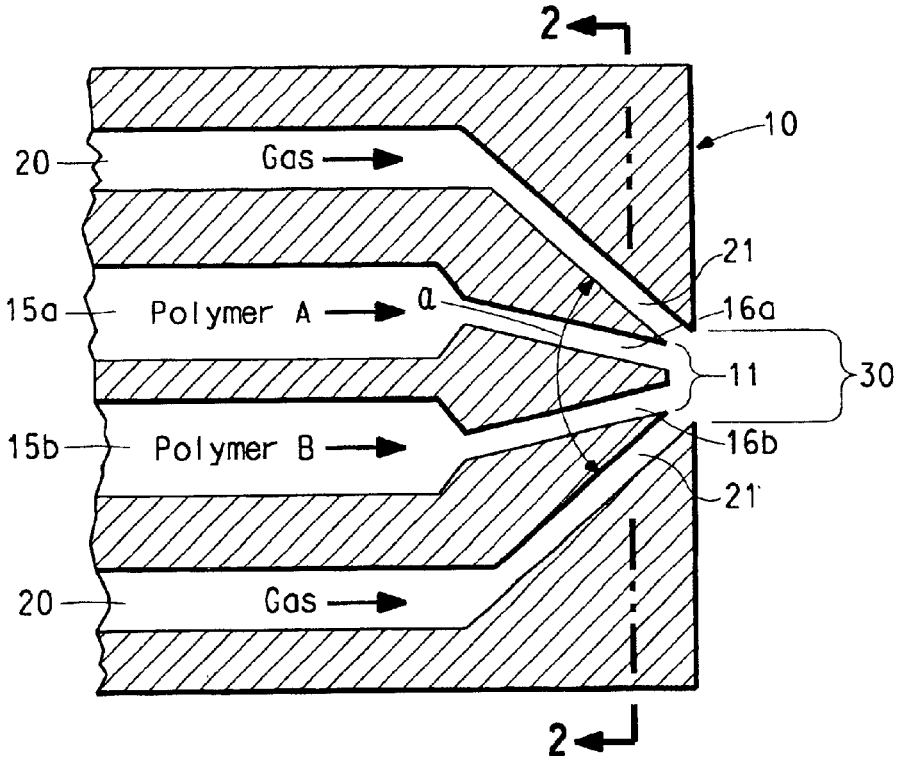
FIG. 1 is a schematic lateral cross-section of a die according to the second embodiment of the present invention or a single die orifice according to the third embodiment of the present invention, used for producing meltblown fibers for use in nonwoven fabrics according to the process of the present invention.

The present invention is directed toward a method for forming multiple component meltblown fibers and multiple component meltblown webs.

The term "polyolefin" as used herein, is intended to mean any of a series of largely saturated open chain polymeric hydrocarbons composed only of carbon and hydrogen atoms. Typical polyolefins include polyethylene, polypropylene, polymethylpentene and various combinations of the ethylene, propylene, and methylpentene monomers.

The term "polyethylene" (PE) as used herein is intended to encompass not only homopolymers of ethylene, but also copolymers wherein at least 85% of the recurring units are ethylene units.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. A common example of a polyester is poly(ethylene terephthalate) (PET) which is a condensation product of ethylene glycol and terephthalic acid.

The terms "meltblown fibers" and "melt blown filaments" as used herein, mean fibers or filaments formed by extruding a melt-processable polymer through a plurality of fine, usually circular, capillaries as molten threads or filaments into a high velocity heated gas (e.g. air) stream. The high velocity gas stream attenuates the filaments of molten thermoplastic polymer material to reduce their diameter to between about 0.5 and 10 microns. Meltblown fibers are generally discontinuous fibers but can also be continuous. Meltblown fibers carried by the high velocity gas stream are generally deposited on a collecting surface to form a web of randomly dispersed fibers.

The terms "multiple component fiber" and "multiple component filament" as used herein refer to any filament or fiber that is composed of at least two distinct polymers, but should be understood to encompass such articles which contain more than two distinct polymers. By the term "distinct polymers" it is meant that each of the at least two polymers are arranged in distinct zones across the cross-section of the multiple component fibers and along the length of the fibers. Multiple component fibers are distinguished from fibers which are extruded from a homogeneous melt blend of polymeric materials in which no zones of distinct polymers are formed. The at least two distinct polymer components useable herein can be chemically different or they can be chemically the same polymer, but having different physical characteristics, such as intrinsic viscosity, melt viscosity, die swell, density, crystallinity, and melting point or softening point. For example, the two components may be linear low density polyethylene and high density polyethylene. Each of the at least two distinct polymers may themselves comprise a blend of two or more polymeric materials. Multiple component fibers are also sometimes referred to as bicomponent fibers, which include fibers formed from two components as well as fibers formed from more than two components. The terms "bicomponent web" or "multiple component web" as used herein refer to a web comprising multiple component fibers or filaments. The terms "multiple component meltblown web" and "bicomponent meltblown web" as used herein mean a web comprising meltblown multiple component fibers containing at least two distinct polymer components, where the molten fibers are attenuated by a high velocity heated gas stream and deposited on a collecting surface as a web of randomly dispersed fibers.

The term "spunbond" fibers as used herein means fibers which are formed by extruding molten thermoplastic polymer material as filaments from a plurality of fine, usually circular, capillaries of a spinneret with the diameter of the extruded filaments then being rapidly reduced by drawing. Spunbond fibers are generally continuous and have an average diameter of greater than about 5 microns. Spunbond nonwoven fabrics or webs are formed by laying spunbond fibers randomly on a collecting surface such as a foraminous screen or belt. Spunbond webs can be bonded by methods known in the art such as by hot-roll calendering or by passing the web through a saturated-steam chamber at an elevated pressure. For example, the web can be thermally point bonded at a plurality of thermal bond points located across the spunbond fabric.

The term "nonwoven fabric, sheet or web" as used herein means a structure of individual fibers, filaments, or threads that are positioned in a random manner to form a planar material without an identifiable pattern, as opposed to a knitted fabric.

FIG. 1 illustrates an extrusion die or spinblock, according to the second or third embodiment of the current invention, for use in the meltblowing process of this invention, which for simplicity illustrates a two component system. Separately controlled multiple extruders (not shown) supply individual melted polymer streams A and B to a die 10 through polymer supply ports 15*a* and 15*b*, where the polymers pass through separate extrusion capillaries 16*a* and 16*b*, which in a preferred embodiment are angled within the die so as to direct the individual polymer streams toward a common longitudinal axis. However, the extrusion capillaries may be parallel to one another, but in close enough proximity to each other so as to promote coalescence of the molten polymer streams after exiting from the individual extrusion capillaries. The extrusion capillaries preferably have a diameter of less than about 1.5 mm, preferably less than 1 mm, and more preferably less than about 0.5 mm. The exits of these capillaries in the die tip 11 are positioned so as to promote the coalescence of the polymers as they exit the die tip through blowing orifice 30. Since the pair of extrusion capillaries 16*a* and 16*b* cooperate to form a single combined bicomponent polymer stream, they are collectively referred to herein as a "combined orifice". The bicomponent fiber that is formed by extrusion of the polymer streams through the combined orifice is attenuated by a heated blowing gas, supplied to the die through gas inlets 20, and delivered to gas jets 21, which are angled toward the common longitudinal axis of the melted polymer streams exiting through the tips of the extrusion capillaries 16*a* and 16*b*. The total included angle $\alpha$ between gas jets 21 is preferably between about 60 degrees and 90 degrees. In this process, through the use of separately controlled extruders for the different polymers, it is possible to individually control the processing parameters, such as temperature, capillary diameter and extrusion pressure, for each polymer so as to optimize the extrusion of the individual polymers and yet still form single fibers that comprise both polymers.

Figure 2:
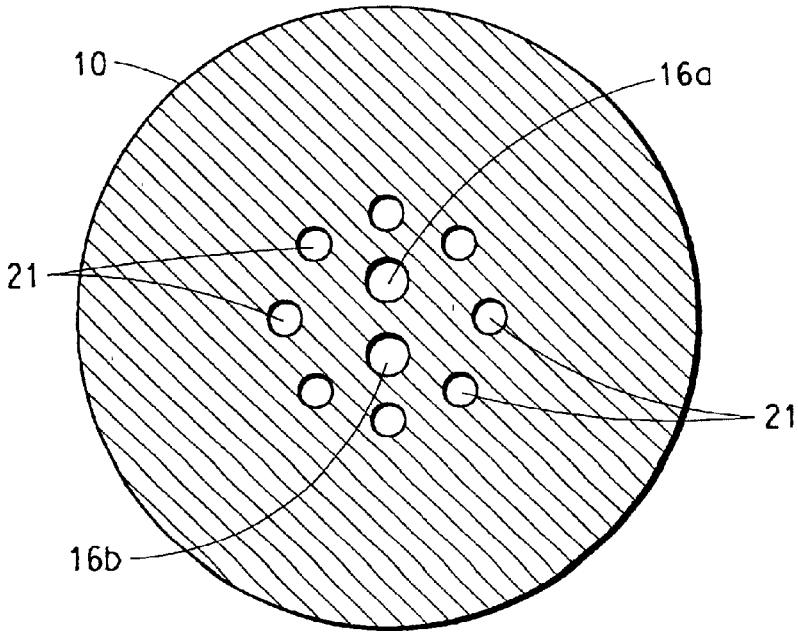
FIG. 2 is a schematic representation of the cross-section 2 of the die in FIG. 1 according to the second embodiment of the invention.

FIG. 2 is a schematic representation of the cross-section 2 of the die 10 in FIG. 1, which is shown as the planar surface of a frustum, illustrating the preferred side-by-side configuration of the extrusion capillary exit tips 16*a* and 16*b*, which deliver the molten polymer filaments into an inverted cone of high velocity gas formed by gas jets 21, arranged concentrically around the exit of the combined orifice.

Figure 3:
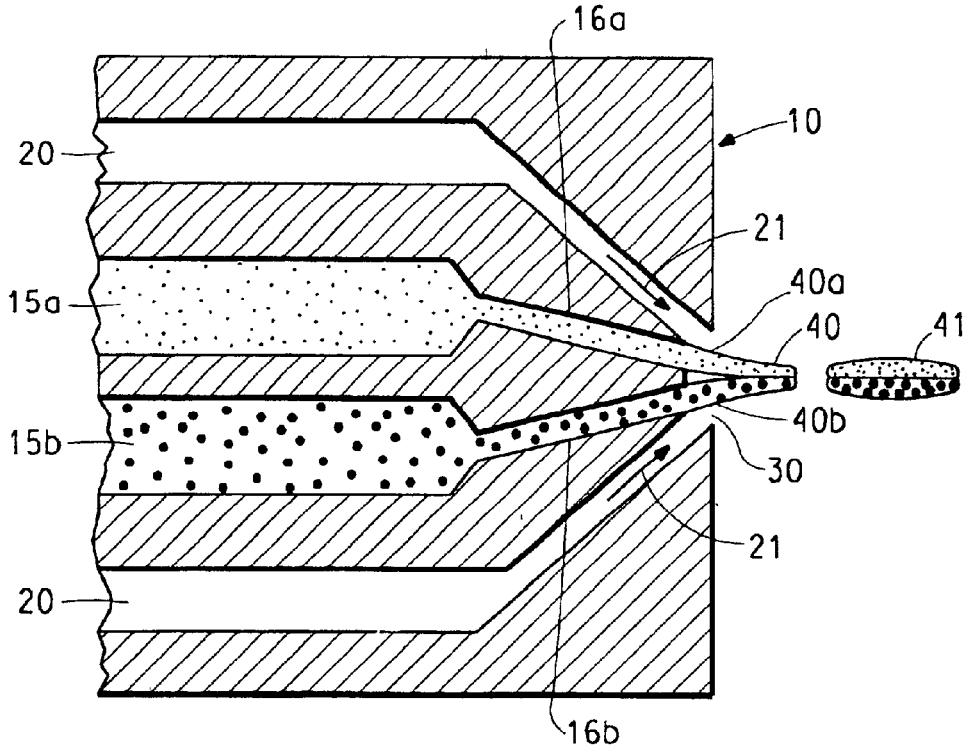
FIG. 3 is an illustration of the die of FIG. 1 in use in the process of the present invention.

FIG. 3 is an illustration according to FIG. 1 which demonstrates the operation of the process of the present invention through extrusion die 10. Polymers A and B are separately delivered through extrusion ports 15*a* and 15*b*, respectively, and are forced into extrusion capillaries 16*a* and 16*b*. An extruded filament 40*a* of polymer A and an extruded filament 40*b* of polymer B exit the extrusion capillary tips, where it is believed the lateral component of the force created by gas jets 21 acts to promote coalescence of the two polymers into a bicomponent filament 40. Nearly simultaneously, the longitudinal component of the force created by gas jets 21 acts to attenuate or stretch the filaments, such that the diameter of the stretched bicomponent filament is reduced to about 10 microns or less. The bicomponent filament may be broken as it exits the blowing orifice 30 to form a plurality of fine discontinuous bicomponent meltblown fibers 41.

Figure 4:
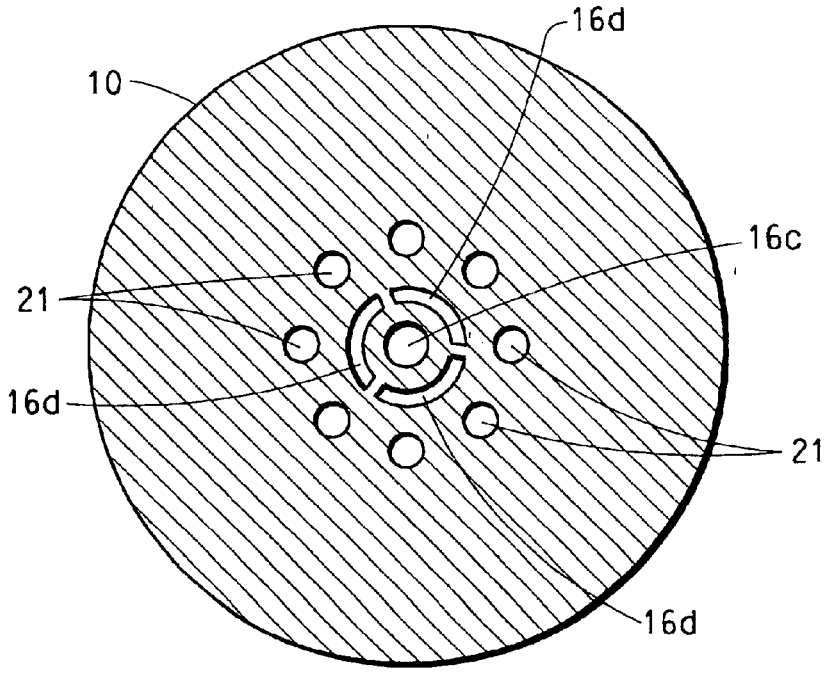
FIG. 4 is a schematic representation of an alternative design for a die according to the second embodiment of the invention illustrated in FIG. 1.

FIG. 4 is a schematic representation, similar to FIG. 2, an alternate design for die 10 according to the second embodiment of the current invention, modified so as to form bicomponent sheath-core fibers. In this embodiment, polymer A is extruded through a central extrusion capillary 16*c*, and polymer B is extruded through a series of extrusion capillaries, exiting the die through a series of curved slots 16*d*, arranged concentrically around the tip of capillary 16*c*. In this embodiment, the combined orifice comprises the central extrusion capillary 16*c* and curved slots 16*d*. A plurality of heated gas jets 21 are arranged concentrically around the combined orifice. Alternately, gas jets 21 can be replaced by an annulus that is concentric with the combined orifice.

Figure 5:
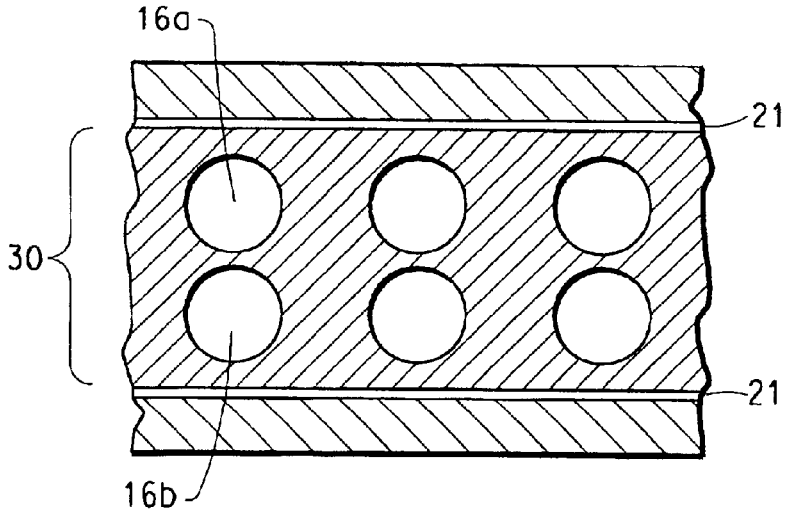
FIG. 5 is an end view of the exit of the third embodiment of the invention of a die according to FIG. 1.

FIG. 5 is an end view of the exit of the die 10 shown in FIG. 1 according to the third embodiment of the invention, wherein a series of combined die orifices, each comprising capillary exits 16*a* and 16*b*, are arranged in a row and extrude the molten polymers into gas jets exiting through slots 21, in combination forming the blowing orifice 30. As the polymer streams exit each of the combined die orifices, they form a curtain of multiple component meltblown filaments extending along the length of die 10.

Figure 6:
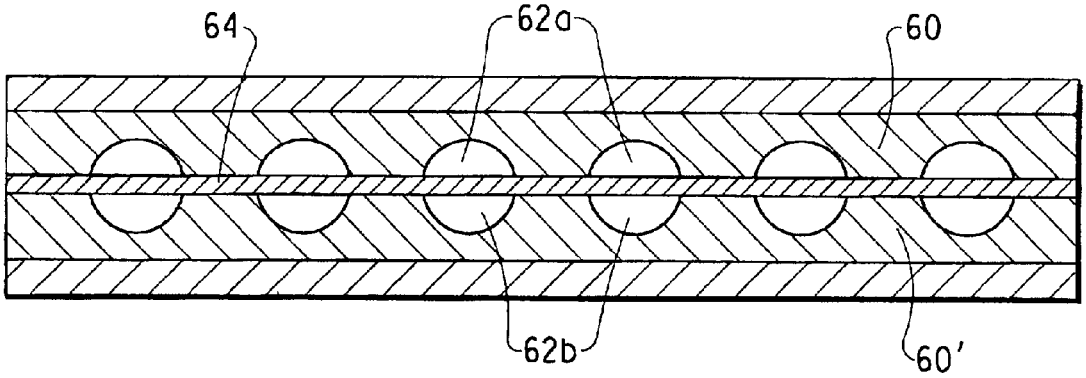
FIG. 6 is an end view of the exit of an alternative design for a die according to the third embodiment of the invention.

FIG. 6 is an alternative design to the die described in FIG. 5. Two vertical etched die plates, 60 and 60', are separated by solid plate, 64, thus forming separate extrusion capillaries, 62*a* and 62*b*. The gas jets, not shown in this view, are disposed laterally adjacent die plates 60 and 60'.

The skilled artisan will recognize that the configurations and shapes of the extrusion capillaries can be modified in numerous ways for various reasons. For example, by machining pie-slice shaped cross-sections in the die tip, the process is able to accommodate delivering more than two polymer components into the fibers to form fibers having a substantially circular cross-section with pie-shaped component cross-sections. Likewise, those skilled in the art will recognize that on a production scale, it can be necessary to use many extruder/die apparatuses ("spin blocks") in order to obtain full coverage of the collection surface so as to produce an acceptable nonwoven web or fabric.

An advantage in practicing the process of the present invention lies in being able to separately control extrusion parameters for the different polymer components. Since each different polymer is delivered through a different extrusion device, in the event that one polymer component has significantly different physical characteristics than does the other polymer component, such as intrinsic viscosity, melt viscosity, die swell, or melting/softening point, extrusion parameters such as temperature, pressure and even extrusion capillary diameter may be varied to accommodate and optimize the extrusion for each polymer.

In the prior art processes, when the polymers are combined before the melts exit the die, an interface exists between the two polymer melts. This interface is not directly controlled and can be influenced by many factors in the process. Two examples of the significant problems that can occur due to the lack of control of this interface are 1) when using two similar polymers the interface may start to diffuse as the polymers start to mix and thus the fiber will be more a melt blend fiber versus a bicomponent fiber; and 2) if the polymers have a significant difference in melt viscosity, it is possible the higher viscosity polymer will start to fill a disproportionate amount of the space available to the melt within the die, which will likely result in a mismatch in the speed of the two melts as they are exiting the die, as the polymer melts can slide past each other along the interface which will likely cause spinning problems. When the two polymers are kept separate until they exit the die, the melts are directly controlled and the above mentioned problems are avoided.

It should be understood that the melt-processable polymers useful in the process of the present invention include any polymer capable of being melt-processed, such as thermoplastics including polyesters, polyolefins, polyamides, such as the nylon-type polymers, urethanes, vinyl polymers, such as the styrene-type polymers, fluoropolymers such as ethylene-tetrafluoroethylene, vinylidene fluoride, fluorinated ethylene-propylene, perfluoro (alkyl vinyl ethers) and the like. A preferred combination of polymers for forming the bicomponent meltblown fibers and bicomponent meltblown webs according to the present process is polyethylene and poly(ethylene terephthalate). Preferably the polyethylene is a linear low density polyethylene having a melt index of at least 10 g/10 min (measured according to ASTM D-1238; 2.16 kg@190° C.), an upper limit melting range of about 120° to 140° C., and a density in the range of 0.86 to 0.97 gram per cubic centimeter. Meltblown webs comprising bicomponent polyethylene/poly(ethylene terephthalate) meltblown fibers are especially useful in nonwoven fabrics for medical end uses since they are radiation sterilizable. The bicomponent polyethylene/poly(ethylene terephthalate) meltblown webs can be bonded to spunbond layers typically used in such end uses to provide composite laminates having a good balance of strength, softness, breathability, and barrier properties. It is also believed that the bicomponent polyethylene/poly(ethylene terephthalate) meltblown fibers have better properties than meltblown single component polyethylene or poly(ethylene terephthalate) fibers. Other preferred polymer combinations useful in the post-coalescence spinning process of the current invention include polypropylene/poly(ethylene terephthalate), poly(hexamethylenediamine adipamide)/poly(ethylene terephthalate), poly(hexamethylenediamine adipamide)/polypropylene, and poly(hexamethylenediamine adipamide)/polyethylene. It is expected that some thermosetting polymers can be used in the process of the present invention, if they remain molten during the process of the invention.

Conventionally, the fibers are deposited on a collecting surface, such as a moving belt or screen, a scrim, or another fibrous layer. Gas withdrawal apparatus such as a suction box may be positioned beneath the collector to assist in the deposition of the fibers and removal of gas. Fibers produced by melt blowing are generally high aspect ratio discontinuous fibers having an effective diameter in the range of about 0.5 to about 10 microns. As used herein, the "effective diameter" of a fiber with an irregular cross section is equal to the diameter of a hypothetical round fiber having the same cross sectional area. The meltblown web preferably has a basis weight between about 2 and 40 $g/m^2$, more preferably between 5 and 30 $g/m^2$, and most preferably between 12 and 35 $g/m^2$.

Without wishing to be bound by theory, it is believed that the gas jets can fracture or split the multiple component filaments into even finer filaments. The resulting filaments are believed to include multiple component filaments in which each filament is made of at least two separate polymer components that both extend substantially the length of the meltblown fiber, for example in a side-by-side configuration. It is also believed that some of the fractured filaments can contain just one polymer component due to the splitting of the multiple component fiber into individual monocomponent fibers. The degree of splittability between the two or more distinct polymeric components of a multiple component meltblown filament can be controlled by selecting the polymeric components to yield the desired degree of adhesion between the distinct polymeric zones.

The fibers in the multiple component meltblown web of the invention are typically discontinuous fibers having an average effective diameter of between about 0.5 microns and 10 microns, and more preferably between about 1 and 6 microns, and most preferably between about 2 and 4 microns. Multiple component meltblown webs are formed from at least two polymers simultaneously spun from a spin block incorporating extrusion dies such as those illustrated in the Figures herein. The configuration of the fibers in the meltblown multiple component web is preferably a bicomponent side-by-side arrangement in which most of the fibers are made of two side-by-side polymer components, with each distinct polymeric component being present in an amount between about 10 to 90 volume percent depending on the desired web properties, that extend and are bonded for a significant portion of the length of each fiber. Alternatively, the bicomponent fibers may have a sheath/core arrangement wherein one polymer is surrounded by another polymer, circular in cross-section with pie-shaped slices of more than two different polymers, or any other conventional bicomponent fiber structure. In a more preferred embodiment, the lower melting polymer is located along a portion of the surface of the fiber so as to enhance bonding between the meltblown fibers on the collecting surface.

According to a preferred embodiment of the invention, a low intrinsic viscosity polyester polymer and polyethylene are combined to make a meltblown bicomponent web in the meltblown web production apparatus. The low viscosity polyester preferably comprises poly(ethylene terephthalate) having an intrinsic viscosity of less than about 0.55 dl/g, preferably from about 0.17 to 0.49 dl/g (measured using ASTM D 2857 as described above), more preferably from about 0.20 to 0.45 dl/g, most preferably from about 0.22 to 0.35 dl/g. The two polymers A and B are melted, filtered, and then metered into the spin block. The melted polymers are extruded through separate extrusion capillaries within the spin block and exit the spin block through an orifice, where they come into contact with gas from the gas jets and are forced into contact with each other, and are attenuated in the longitudinal direction to form high aspect ratio fibers. The meltblown bicomponent fibers may be broken by the heated gas jets to form discontinuous fibers however they can be continuous fibers. Preferably, the gas jets generate the desired side-by-side fiber cross-section.

A composite nonwoven fabric incorporating the multiple component meltblown web described above can be produced in-line by collecting the multiple component meltblown fibers on a different sheet material such as a spunbond fabric, woven fabric, or foam. The layers may be joined using methods known in the art such as by thermal, ultrasonic, and/or adhesive bonding. The meltblown layer and other fabric or sheet layer preferably each include polymeric components which are compatible so that the layers can be thermally bonded, such as by thermal point bonding. For example, in a preferred embodiment, the composite laminate comprises a meltblown web and spunbond web, each of which include at least one substantially similar or identical polymer. Alternatively, the layers of the composite sheet can be produced independently and later combined and bonded to form the composite sheet. It is also contemplated that more than one spunbond web production apparatus could be used in series to produce a web made of a blend of different single or multiple component fibers. Likewise, it is contemplated that more than one meltblown web production apparatus could be utilized in series in order to produce composite sheets with multiple meltblown layers. It is further contemplated that the polymer(s) used in the various web production apparatuses could be different from each other. Where it is desired to produce a composite sheet having just one spunbond layer and one fine meltblown fiber layer, the second spunbond web production apparatus can be turned off or eliminated.

Optionally, a fluorochemical coating can be applied to the composite nonwoven web to reduce the surface energy of the fiber surface and thus increase the fabric's resistance to liquid penetration. For example, the fabric may be treated with a topical finish treatment to improve the liquid barrier and in particular, to improve barrier to low surface tension liquids. Many topical finish treatment methods are well known in the art and include spray application, roll coating, foam application, dip-squeeze application, etc. Typical finish ingredients include ZONYL® fluorochemical (available from DuPont, Wilmington, Del.) or REPEARL® fluorochemical (available from Mitsubishi Int. Corp, New York, N.Y.). A topical finishing process can be carried out either in-line with the fabric production or in a separate process step. Alternatively, such fluorochemicals could also be spun into the fiber as an additive to the melt.

Test Methods

In the description above and in the examples that follow, the following test methods were employed to determine various reported characteristics and properties. ASTM refers to the American Society for Testing and Materials.

Fiber Diameter was measured via optical microscopy and is reported as an average value in microns. For each meltblown sample the diameters of about 100 fibers were measured and averaged.

Basis Weight is a measure of the mass per unit area of a fabric or sheet and was determined by ASTM D-3776, which is hereby incorporated by reference, and is reported in $g/m^2$.

The intrinsic viscosity of polyester as used herein is measured according to ASTM D 2857, using 25 vol. % trifluoroacetic acid and 75 vol. % methylene chloride at 30° C. in a capillary viscometer. Frazier Air Permeability is a measure of air flow passing through a sheet under at a stated pressure differential between the surfaces of the sheet and was conducted according to ASTM D 737, which is hereby incorporated by reference, and is reported in $m^3/min/m^2$.

EXAMPLES

Composite sheets comprising an inner layer of meltblown fibers sandwiched between spunbond outer layers were prepared in Examples 1–4. The same spunbond outer layers were used in each of these examples and comprised bicomponent filaments with a sheath-core cross section.

The spunbond layers were made from bicomponent fibers of linear low density polyethylene (LLDPE) with a melt index of 27 g/10 minutes (measured according to ASTM D-1238 at a temperature of 190° C.) which was a blend of 20 weight percent ASPUN 6811A LLDPE and 80 weight percent ASPUN 61800-34 LLDPE (both available from Dow), and poly(ethylene terephthalate) (PET) having an intrinsic viscosity of 0.53 dl/g available from DuPont as Crystar® 4449 polyester. The polyester resin was crystallized at a temperature of 180° C. and dried at a temperature of 120° C. to a moisture content of less than 50 ppm before use. The polyester was heated to 290° C. and the polyethylene was heated to 280° C. in separate extruders. The polymers were extruded, filtered and metered to a bicomponent spin block having 4000 holes/meter (2016 holes in the pack) maintained at 295° C. and designed to provide a sheath-core filament cross section. The polymers were spun through the spinneret to produce bicomponent filaments with a polyethylene sheath and a poly(ethylene terephthalate) core. The total polymer throughput per spin block capillary was 1.0 g/min. The polymers were metered to provide filaments that were 30% polyethylene (sheath) and 70% polyester (core), based on fiber weight. The filaments were cooled in a 15 inch (38.1 cm) long quenching zone with quenching air provided from two opposing quench boxes a temperature of 12° C. and velocity of 1 m/sec. The filaments passed into a pneumatic draw jet spaced 26 inches (66.0 cm) below the capillary openings of the spin block where the filaments were drawn. The resulting smaller, stronger substantially continuous filaments were deposited onto a laydown belt moving at a speed of 186 m/min, using vacuum suction to form a spunbond web having a basis weight of 0.6 oz/yd$^2$ (20.3 g/m$^2$). The fibers in the web had an average diameter of about 11 microns. The resulting webs were passed between two thermal bonding rolls to lightly tack the web together for transport using a point bonding pattern at a temperature of 100° C. and a nip pressure of 100 N/cm. The lightly bonded spunbond web was collected on a roll. Preparation of the meltblown layer for each of the examples is described below.

Composite nonwoven sheets were prepared in Examples 1–4 by unrolling the bicomponent spunbond web onto a moving belt and laying the meltblown bicomponent web on top of the moving spunbond web. A second roll of the spunbond web was unrolled and laid on top of the spunbond-meltblown web to produce a spunbond-meltblown-spunbond composite nonwoven web. The composite web was thermally bonded between an engraved oil-heated metal calender roll and a smooth oil heated metal calender roll. Both rolls had a diameter of 466 mm. The engraved roll had a chrome coated non-hardened steel surface with a diamond pattern having a point size of 0.466 mm$^2$, a point depth of 0.86 mm, a point spacing of 1.2 mm, and a bond area of 14.6%. The smooth roll had a hardened steel surface. The composite web was bonded at a temperature of 120° C., a nip pressure of 350 N/cm, and a line speed of 50 m/min. The bonded composite sheet was collected on a roll. The final basis weight of each of the composite nonwoven sheets was approximately 58 g/m$^2$.

Examples 1–4

The meltblown bicomponent webs in these examples were made using a post-coalescence meltblowing process. Bicomponent fibers were prepared in a side-by-side arrangement. with Crystar® poly(ethylene terephthalate) available from DuPont having an intrinsic viscosity of 0.53 and a moisture content of about 1500 ppm, and linear low density polyethylene (LLDPE) with a melt index of 100 g/10 minutes (measured according to ASTM D-1238) available from Dow as ASPUN 6806. The polyethylene polymer was heated to 450° F. (232° C.) and the polyester polymer was heated to 572° F. (300° C.) in separate extruders. The two polymers were separately extruded, filtered and metered to a bicomponent spin block having the die tip configuration shown in FIG. 6. The die was formed from two vertical-etched plates 60 and 60' having parallel grooves 62*a* and 62*b* formed therein, the grooves having a radius of 0.2 mm. The two plates were separated by a 2 mil thick solid plate 64 in order to keep the two polymer streams separate until after they exit the extrusion capillaries. One of the polymer streams was fed through the capillaries formed by grooves 62*a* and the other polymer stream was fed through the capillaries formed by grooves 62*b*. The exit holes of the extrusion capillaries were spaced at 30 holes/inch along the length of the die tip with the die tip having a length of about 21 inches (53 cm). The spin block die was heated to 572° F. (300° C.) and the polymers were spun through the capillaries at polymer mass flow rates given in Table 1. Attenuating air was heated to a temperature of 310° C. and supplied at an air pressure of 9 psi (62 kPa) through two 1.5 mm wide air channels. The two air channels ran the length of the approximately 21 inch (53 cm) line of capillary openings, with one channel on each side of the line of capillaries set back 1.5 mm from the capillary openings. Each of the air channels were oriented at an angle of 45 degrees to the plane of plate 64 with the axes of the air channels converging toward the extrusion capillary exits, for a total included angle between the air channels of 90 degrees. The polyethylene and poly (ethylene terephthalate) polymers were supplied to the spin block using two different extruders. The temperature of the polyethylene as it exited the extruder was 265° C. and the temperature of the poly(ethylene terephthalate) was 295° C. The mass flow rates of the polymers supplied to the spin block were varied for each example and are given in Table 1. The filaments were collected on a forming screen moving at a speed of 52 m/min and with the upper surface thereof located 5.5 inches (14.0 cm) below the end of the die tip to produce a meltblown web which was then collected on a roll. The meltblown webs in each example had a basis weight of 11.7 g/m$^2$.

Example 5

A meltblown bicomponent web was made with a linear low density polyethylene (LLDPE) component having a melt index of 135 g/10 minutes (measured according to ASTM D-1238) available from Equistar as GA594 and a poly(ethylene terephthalate) component having a reported intrinsic viscosity of 0.53 available from DuPont as Crystar® polyester (Merge 4449). The LLDPE and poly(ethylene terephthalate) polymers were heated in separate extruders to temperatures of 260° C. and 305° C., respectively. The two polymers were separately extruded and metered to two independent polymer distributors. The planar melt streams exiting each distributor were filtered independently and extruded through a bicomponent meltblown die having two linear sets of independent holes, a first set for extruding the LLDPE and a second set for extruding the poly(ethylene terephthalate). The holes were arranged in pairs such that each LLDPE spin orifice was located in close proximity to a poly(ethylene terephthalate) spin orifice, each of the pairs of spin orifices cooperating as a combined orifice, such that a linear array of combined orifices was formed along the length of the die tip. The pairs of orifices which form each combined orifice were arranged such that a line passing through the centers of both orifices in each pair is perpendicular to the direction of the linear array of hole pairs, with the center point between the 2 holes in the pair being located on the vertex of the die tip. The die had 645 pairs of capillary openings arranged in a 54.6 cm line. The die was heated to 305° C. and the LLDPE and poly(ethylene terephthalate) were spun at throughputs of 0.16 g/hole/min and 0.64 g/hole/min, respectively. Attenuating air was heated to a temperature of 305° C. and supplied at a pressure of 5.5 psi through two 1.5 mm wide air channels. The two air channels ran the length of the 54.6 cm line of capillary openings, with one channel on each side of the line of capillaries set back 1.5 mm from the capillary openings. The LLDPE and poly(ethylene terephthalate) were supplied to the spin pack at rates of 6.2 kg/hr and 24.8 kg/hr, respectively, to provide a bicomponent meltblown web that was 20 weight percent LLDPE and 80 weight percent poly(ethylene terephthalate). The web was formed by collecting the meltblown fibers at a die to collector distance of 20.3 cm on a moving forming screen to produce a meltblown web which was wound on a roll. The meltblown web had a basis weight of 1.5 oz/yd$^2$ (50.9 g/m$^2$) and the Frazier air permeability of the sample was 86 ft$^3$/min/ft$^2$ (26.2 m$^3$/min/m$^2$).

Comparative Example A

This example demonstrates formation of a bicomponent meltblown web wherein the two polymer streams converge prior to exiting the die tip. The same polymers and spinning equipment were used as in Examples 1–4 except that solid plate 64 shown in FIG. 6 was removed so that the two polymer streams were in contact in the extrusion capillaries. The polymer temperatures and mass flow rates, die temperature, air pressure and temperature were identical to those used in Example 1. The meltblown web had a basis weight of 17 g/m$^2$.

TABLE 1

Meltblown Process Conditions and Meltblown Web Properties

| Example | LLDPE Mass Flow Rate (kg/hr) | PET Mass Flow Rate (kg/hr) | Weight Ratio (% PE) | Meltblown Web Frazier (m$^3$/min/m$^2$) | Fiber Size in Meltblown Web ($\mu$) | Composite Sheet Frazier (m$^3$/min/m$^2$) |
|---|---|---|---|---|---|---|
| 1 | 6 | 24 | 20 | 23.2 | 2.8 | 10.4 |
| 2 | 12 | 18 | 40 | — | — | 11.6 |
| 3 | 18 | 12 | 60 | — | — | 17.4 |
| 4 | 24 | 6 | 80 | — | — | 9.4 |
| 5 | 6.2 | 24.8 | 20 | 26.2 | — | — |
| A | 6 | 24 | 20 | 23.8 | 3.0 | 13.7 |

What is claimed is:

1. A process for forming multiple component meltblown fibers comprising extruding a first melt-processable polymer through first extrusion orifices, simultaneously extruding a second melt-processable polymer through second extrusion orifices, fusing said first and second melt-processable polymers into extruded composite filaments after extrusion, pneumatically attenuating and breaking said extruded composite filaments with at least one jet of high velocity gas so as to form said multiple component meltblown fibers, and collecting said fibers.

2. The process of claim 1 wherein the composite filaments are attenuated with a plurality of high velocity gas jets.

3. The process according to claim 1, wherein said first and second melt-processable polymers have different viscosities as a function of temperature.

4. The process according to claim 1, wherein said first and second melt-processable polymers have different melting and/or softening points.

5. The process according to claim 1, wherein said first and second melt-processable polymers are chemically different polymers.

6. The process according to claim 5, wherein said first melt-processable polymer is a polyester and the second melt-processable polymer is polyethylene.

7. The process according to claim 6 wherein said polyester is poly(ethylene terephthalate).

* * * * *